US005941190A

United States Patent [19]

Kyle

[11] Patent Number: 5,941,190

[45] Date of Patent: Aug. 24, 1999

[54] HATCH ASSEMBLY FOR A MARINE VESSEL

[75] Inventor: James H. Kyle, Keene, N.H.

[73] Assignee: Pompanette, Inc., Charlestown, N.H.

[21] Appl. No.: 08/937,735

[22] Filed: Sep. 25, 1997

[51] Int. Cl.[6] ..... B63B 19/12

[52] U.S. Cl. ..... 114/201 R

[58] Field of Search ..... 49/476.1, DIG. 2, 49/394; 296/216.2, 216.6, 216.7; 114/201 R, 201 A, 203, 117, 173, 176, 177, 178

[56] References Cited

U.S. PATENT DOCUMENTS 4,750,781 6/1988 Betteridge ..... 296/216.02
5,848,575 12/1998 Freeman et al. ..... 114/203

*Primary Examiner*—Ed L. Swinehart
*Attorney, Agent, or Firm*—Dougherty & Troxell

[57] ABSTRACT

A hatch assembly includes a shaped lens or hatch cover and a rectangular shaped plastic frame member. The frame member includes an inwardly directed L-shaped cross section with an outwardly directed (away from the interior of the vessel) extension element at one end of one of the segments of the L-shaped cross section. The frame member surrounds the lens element or panel in a superposed and overlapping arrangement with a frame member abutting the vessel wall. The lens element is adjacent to and essentially surrounded by the outwardly directed extending element when the hatch is in the closed position. The hatch also includes a hinge for rotatably connecting the hatch cover and the frame member for opening and closing the hatch assembly and a gasket disposed between the outer peripheral area of the cover and the frame member. Releasable clamp member such as a dog and catch are provided for clamping the hatch in a closed position.

12 Claims, 5 Drawing Sheets

HATCH ASSEMBLY FOR A MARINE VESSEL

FIELD OF THE INVENTION

This invention relates to a hatch assembly for a marine vessel, or the like, and more particularly to an plastic hatch assembly that reduces the likelihood of water entering the cabin when the hatch is opened or closed.

BACKGROUND OF THE INVENTION

Cast aluminum hatch assemblies for marine vessels are well known. For example, such hatches are commercially available from Pompanette, Inc., of Charlestown, N.H., the assignee of the present invention. Such assemblies are also described in my co-pending application entitled "Improved Hatch Assembly For A Marine Vessel" Ser. No. 08/600,542, filed on Feb. 13, 1996 and assigned to the same assignee of the present invention, now U.S. Pat. No. 5,676,082.

It is now believed that there may be a significant commercial demand for an improved hatch assembly which reduces or minimizes the likelihood of residual water which accumulates around a hatch due to rain, spray or washing down of the vessel, from entering the cabin when the hatch is open or closed. It is also believed that there may be a significant demand for a plastic hatch assembly which presents a low profile, has a pleasing appearance and which can be manufactured at a favorable cost.

Accordingly, the hatch assembly in accordance with the present invention offers a number of advantages over prior art assemblies. For example, the hatch such assembly according to the present invention may be manufactured from plastic at a favorable cost, has a low profile and presents a pleasing appearance which is compatible with most leisure and some commercial marine craft. The hatch assembly in accordance with one embodiment of the invention also significantly reduces the likelihood of residual water entering a vessel or cabin when opening or closing the hatch. This protection against unwanted water entering a cabin is also effective in the event that one or more drains in the vicinity of the hatch become clogged. In addition, the hatch assemblies disclosed herein facilitate the removal of a lens element for cleaning or replacement, incorporate a hidden hinge to further enhance their appearance, and are relatively durable with respect to salt water. Such assemblies also facilitate installation by conforming to slight variations in the plane of installation. The hatch assemblies is disclosed herein may also incorporate a rachet like mechanism for installation of a trim ring and facilitate installation of the trim ring on vessels having different hull or cabin wall thicknesses.

BRIEF SUMMARY OF THE INVENTION

In essence, the present invention contemplates a hatch or hatch assembly which may be open or closed for gaining access to the interior of a marine vessel. The hatch includes a hatch cover such as a shaped lens or closing element. As for example, a clear, tinted or even opaque plastic panel having a peripheral area which is bonded by an outer edge. The hatch also includes a shaped plastic frame member which is preferably of a generally rectangular shape and generally similar to the shape of the lens element. The frame member also has an inwardly directed (toward the interior of the vessel) L-shaped cross section with an outwardly directed (in a direction away from the interior of the vessel) extension element at one end of one of the segments of the L ie the segment which is generally parallel to the wall of the vessel. The frame member surrounds the lens element or panel in a superposed and overlapping arrangement with the frame member abutting the vessel wall and the lens element exterior thereof. With this arrangement the lens element is adjacent to and essentially surrounded by the outwardly directed or extending element when the hatch is in a closing position. The hatch assembly also includes means for fastening, such as a series of screws, the frame member within an aperture in the vessel and means such as a hinge for rotatably connecting the lens element to the frame member for opening and closing the hatch assembly. Sealing means such as an elastomeric gasket is disposed between the outer peripheral area of the lens element and the frame member and in the preferred embodiment is adhesively attached to the lens element. Releasable clamp means, such as a dog and catch, clamp the lens element and frame member in a close position with the gasket therebetween to seal the hatch and prevent water from entering the interior of the vessel through the closed hatch.

In a further embodiment of the invention, a hatch for a marine vessel includes a shaped lens element and a ring shaped frame member which is generally similar to the structure described above. However, in this embodiment, the frame member also includes an outwardly extending portion or shoulder at the intersection of the two segments of the L-shaped cross section. This portion or shoulder forms a channel between the shoulder and the outwardly extending extension element. A resilient gasket is disposed between the outer peripheral area of the lens element and the frame member and is of a size that fills a majority of the channel and seals the frame member and lens element when in a closed position.

The invention will now be described in connection with the accompanied drawings wherein like reference numerals have been used to indicate like parts.

DETAILED DESCRIPTION OF THE PREFERRED EMBODIMENTS OF THE INVENTION

Figure 1:
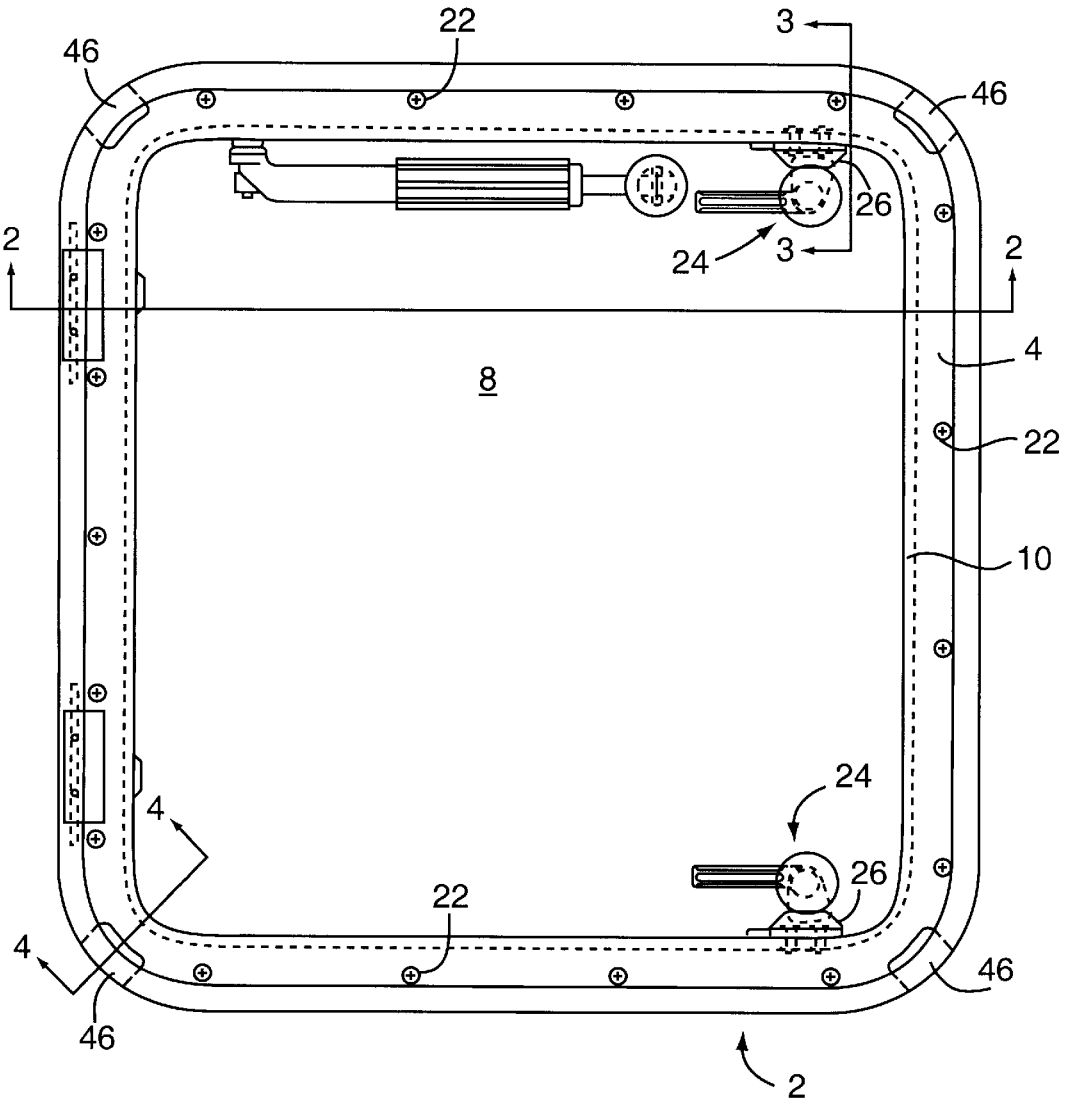
FIG. 1 is a top or plan view of a hatch assembly in accordance with a first embodiment of the invention.

A marine hatch assembly 2 for fitting within an opening in a marine vessel typically includes an open and a closed position. The hatch assembly 2 includes a shaped hatch cover or lens element 8 such as a clear, tinted or opaque plastic-panel having a peripheral area which is boarded by and adjacent to an outer edge 10. The assembly 2 also includes a shaped frame member 4 which is preferably of plastic such as the well known ABS or other suitable plastic as will be well understood by those skilled in the art of plastic structures. The frame member 4 has a shape which is similar to but somewhat larger than the shaped lens element 8. In a preferred embodiment of the invention, the frame member 4 and lens element 8 each have a generally rectangular shape, however, other similar shapes may be used. It should also be recognized that the frame member 4 and lens element 8 have similar or mating shapes with respect to the opening and closing portions. Nevertheless, an outer portion of the frame member may vary for decorative purposes.

In a preferred embodiment of the invention, the ring member 4 which may sometimes be referred to as a ring shape since it surrounds the opening in the vessel has an L-shaped cross section which includes an inwardly directed (toward the interior of the vessel) segment 12 (FIG. 2) and a peripheral segment 14 which extends outwardly away from the center of the hatch and generally parallel with the deck, wall or roof of the vessel in which the assembly 2 is installed.

The ring member 4 also includes a raised extension element 16 at the outer end of segment 14. In one embodiment of the invention, the raised extension element 16 has a generally U-shape as shown more clearly in FIG. 3. The member 4 also includes an outwardly extending or raised portion or shoulder 18 which extends outwardly or upwardly toward the exterior of the vessel. This portion or shoulder 18 is at the intersection of the segments 12 and 14 and appears as an extension of the segment 12. A first wall 17 of the extension element 16 is generally parallel with a corresponding wall 19 of the shoulder 18 but extends outwardly for greater distance than shoulder 18. The element 16 and shoulder 18 form a relatively shallow channel 21 therebetween.

Fastening means such as a plurality of metal fasteners or screws 22 are provided for fastening the frame member 4 to the hull of the vessel. These screws 22 may for example pass through a plurality of openings in the segment 14.

The hatch assembly 2 also includes releasable clamp means such as conventional rotatable dog 24 and catch member 26 for clamping the hatch assembly in a closed position and for opening the hatch. The dog 24 is attached directly to the lens element as for example by ultrasonic welding or by a suitable adhesive.

Figure 3:
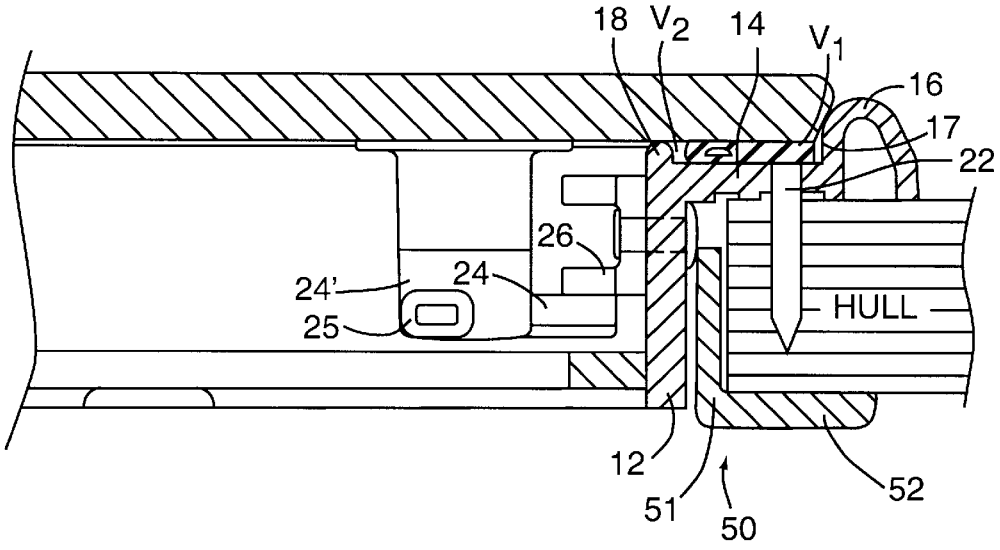
FIG. 3 is a cross-sectional view taken along the line 3—3 in FIG. 1.

As illustrated, more particularly in FIG. 3, the rotatable dog 24 engages the catch member 26 to clamp the lens element 8 in a sealed or closed position. The dog 24 may also be used to secure the hatch in a partially open position by positioning a tongue portion 24' in a groove in the catch member 26.

The catch member 26 is fixed to the segment 12 by any conventional means such as a rivet shown in phantom lines in FIG. 3. To open the hatch, the tongue 24' is rotated out of engagement with the catch member 26 by means of a handle 25.

One important feature of the present invention resides in the means for reducing the likelihood of residual water entering the vessel when the hatch is open. Residual water refers to the water that remains on or around a hatch after exposure to rain, spray from rough water or washing of the vessel, as for example is done to remove the residue from salt spray. The shoulder 18 which is lower than the extension element 16 forms the relatively shallow channel 21 which extends across an inner peripheral area of the frame member 4. A key shaped gasket member 28 is attached to the inner side of the outer peripheral edge of the lens element 8 adjacent to the outer edge 10 and is adapted to fit within the channel 21 when the hatch is closed. The gasket may for example be attached to the lens element by means of a suitable double sided adhesive tape 28'.

Figure 6:
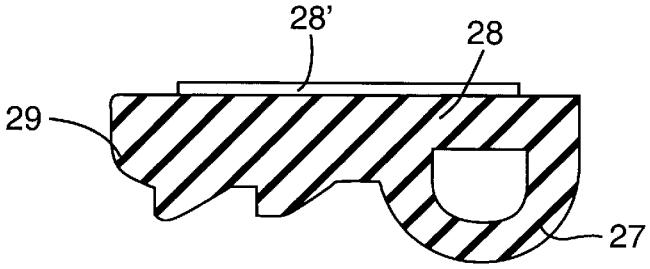
FIG. 6 is a side cross sectional view of a gasket as used in a preferred embodiment of the invention.

In a preferred form, the gasket 28 which extends around the peripheral area of the lens area 8 includes an enlarged inner portion 27 (see FIG. 6) having a hollow passage way extending therethrough and an outwardly ie away from the center of the frame member 4 extending solid portion 29. The gasket is made of a conventional elastomer of the type commonly used for marine applications ie one which will withstand repeated exposure to salt water and pressure. The hollow portion of the gasket is generally more readily compressible and tends to force a majority of water and the channel 21 toward the outside of the channel and away from the opening in the frame member 4. As illustrated, the gasket 28 forms two smaller channels between the gasket 28 and shoulder 18 and between the solid portion 29 and the wall 17. With this arrangement, the volume $V_2$ of the inner channel is greater than the $V_1$ of the outer channel so that any residual water in the outer channel will not fill or overflow the channel 21 when the hatch is open.

Another feature of the present invention resides in the concentric and relatively close fit between the outer edge of the lens element 8 and the extension element 16 of the frame member 4. This arrangement reduces or tends to minimize the amount of water which enters the area therebetween and which is normally carried off by the drains 46 (see FIGS. 1, 4 and 5). While these drains are effective in carrying off most water which accumulates around the lens element 8 and frame 4, there are times when they may become clogged. For this reason, the aforementioned gasket and channel arrangement are provided to further reduce the amount of water that enters the vessel through the hatch assembly.

Figure 5:
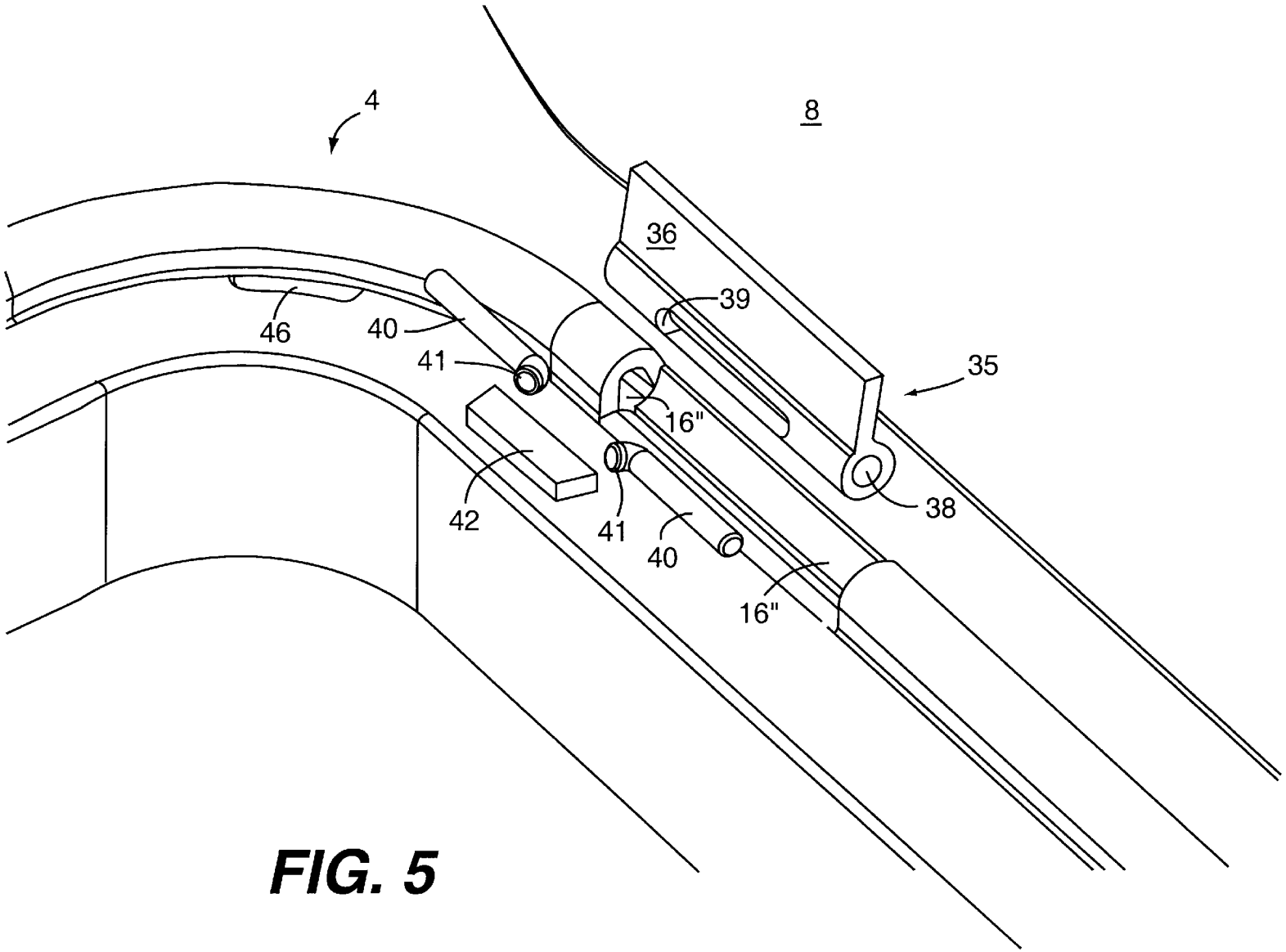
FIG. 5 is a exploded perspective view of the hinge assembly as used in a preferred embodiment of the invention.

The plastic hatch assembly 2 in accordance with a further embodiment of the invention includes a hiden hinge assembly or preferably a pair of hiden hinges. In this embodiment of the invention, the raised extension element 16 forms a generally symmetrical bore 16' (see FIG. 5) and a cut out portion 16" preferably a pair of such cut out portions. This pair of cut out portions are formed in one side of the frame member 4. A hinge 35 as shown in FIG. 5, includes a relatively flat portion 36 and a complimentary cylindrical portion 38. This cylindrical portion 38 also includes a central bore 39 and is disposed on one side of the flat base portion 36.

Figure 4:
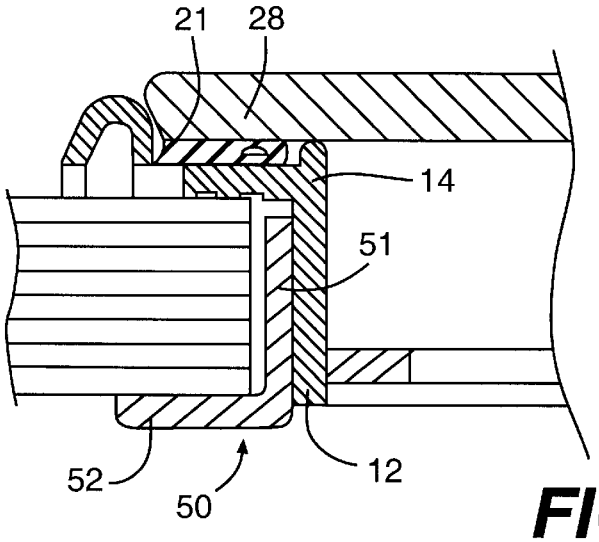
FIG. 4 is a cross-sectional view taken along the line 4—4 in FIG. 1.

In a preferred embodiment of the invention, the flat portion 36 is ultrasonicly welded to the lens element 8, however, can be attached by other conventional means. The cylindrical portion 38 is also sized to fit relatively snugly within the cut out portion 16" for rotation about a pair of hinge pins 40. The cylindrical portion 38 also includes a longitudinally extending slot 42 for connecting the central bore 39 with the outer surface of the cylindrical portion 38. This slot is generally parallel with the bore 39 of the portion 38. The hinge pins 40 which are preferably of steel are disposed within the bore 39 and extend into the bore 16'. The hinge 35 also includes biasing means such as a rubber block 42 or slug to bias the pins 40 outwardly and into the bore 16'. The hinge pins 40 also include an outwardly extending portion 41 which is provided for removing the lens element 8 from the frame member 4, as for example, by forcing the pins 40 together and out of the bore 16'. As shown in FIGS. 1, 4 and 5, the hatch assembly also includes a plurality of drains 46, as for example, one at each corner of the frame member 4.

Figure 2:
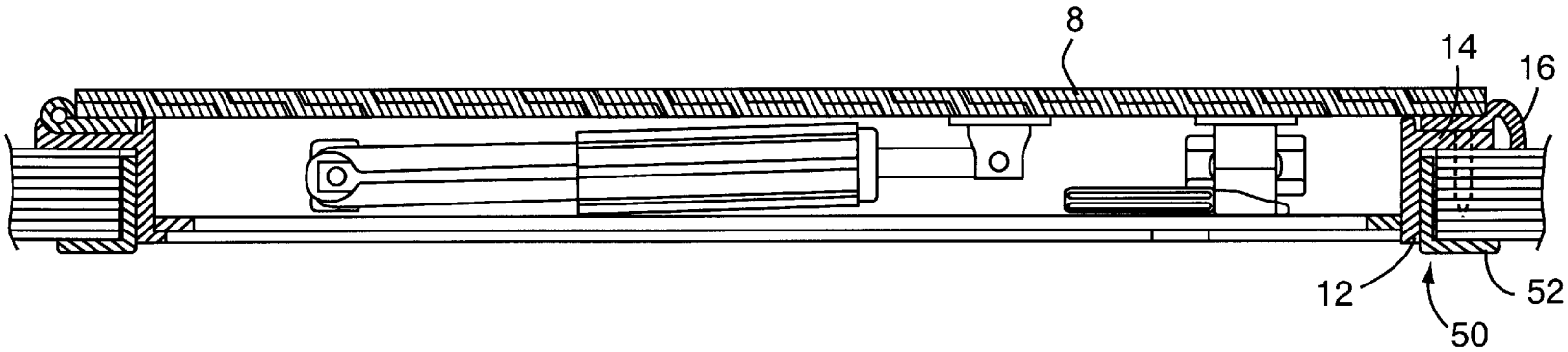
FIG. 2 is a cross-sectional view of the hatch assembly shown in FIG. 1 taken along the line 2—2.

A collet arm as shown in FIGS. 1 and 2 may also be used to clamp the hatch in an open position. The collet arm is of a conventional design and is fastened to the lens element 8 as for example by ultrasonic welding or other conventional means and into the frame member 4 as for example by a suitable bolt or other means.

Figure 7:
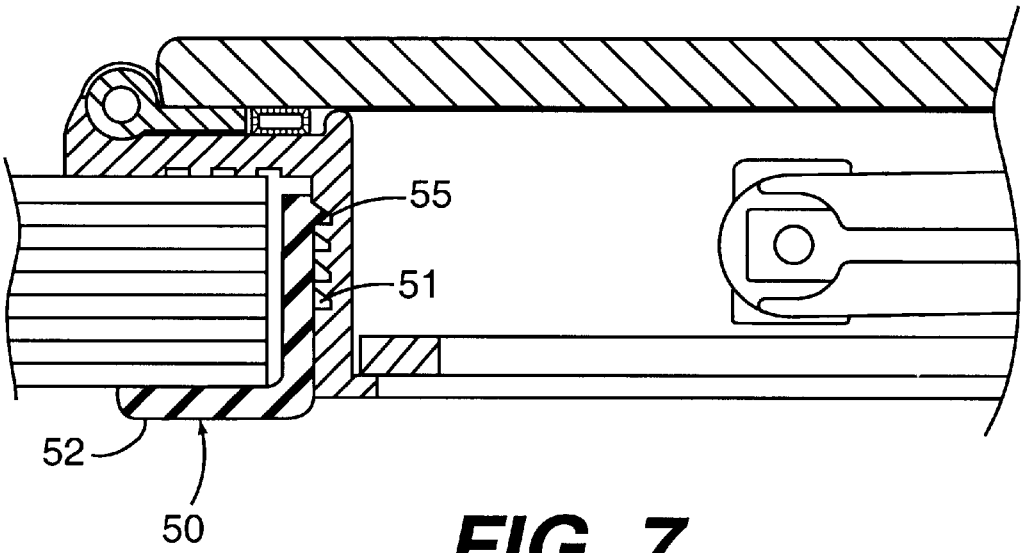
FIG. 7 is a side view of a portion of a hatch assembly in accordance with another embodiment of the invention; and, FIG. 8 is a side view of a rachet mechanism as used in one embodiment of the invention.
Figure 8:
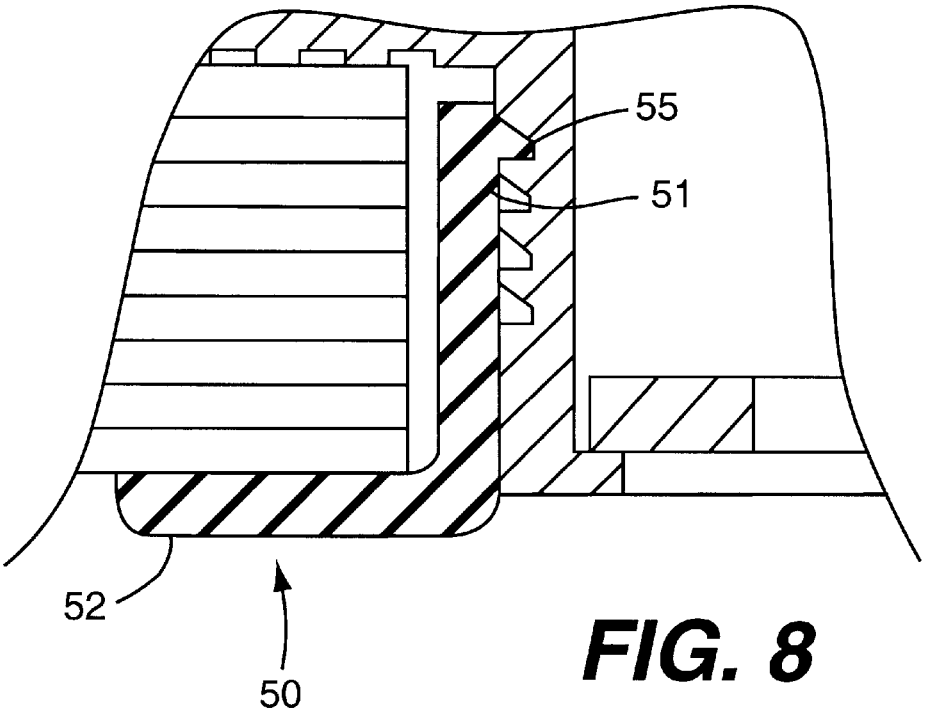

Another embodiment of the invention incorporates a concentric plastic trim ring 50 which is preferably made of the same plastic as the frame member 4. This trim ring 50 has a generally L-shaped cross section and is disposed in a telescoping arrangement with the segment 12 of the frame member 4. As illustrated, the trim ring 50 includes a first segment 51 which is adjacent to the segment 12 and a second or peripheral segment 52 which is adjacent to an abutting the hull of the vessel, cabin roof or the like. The segment 52 can be fixed to the hull in a conventional manner such as by a plurality of screws, adhesives, or etc. However, in one embodiment of the invention, as shown in FIGS. 7 and 8 a tongue and groove or rachet mechanism 55 fixes the trim ring 50 in place with respect to the segment 12 of the frame member 4.

While the invention has been disclosed in connection with its preferred embodiments, changes and modifications may be made therein without departing from the scope of the appended claims.

What is claimed is:

1. A plastic hatch assembly having an open and closed position for fitting within an opening in a marine vessel, said hatch assembly comprising:

a shaped lens element having an outer peripheral area and a plastic frame member having an inwardly extending L-shape cross section with an outwardly extending extension element having a generally U-shaped cross section at one end thereof surrounding said lens element in a superposed and overlapping arrangement with the peripheral area of said lens element adjacent to and essentially surrounded by said outwardly extending extension element when the hatch assembly is in a closed position, means for fastening said frame member within the opening in the vessel and hinge means for rotatably fastening said lens element to said frame member for opening and closing the hatch assembly, gasket means disposed between the outer peripheral area of said lens element and said frame member and releasable clamp means for clamping said lens element and said frame member together in a closed position with said gasket means therebetween to thereby seal the hatch assembly and prevent water from entering the interior of the vessel.

2. A plastic hatch assembly according to claim 1, in which said releasable clamp means includes a rotatable dog fixed to said lens element and a catch element fixed to said frame member.

3. A plastic hatch assembly according to claim 1, in which said gasket means is adhesively fixed to the peripheral area of said lens element.

4. A plastic hatch assembly accordingly to claim 1, in which said frame member includes an outwardly extending shoulder element which forms a channel between said shoulder element and said U-shaped extension and wherein said gasket means engages said frame member between said shoulder element and said U-shaped extension element when said hatch is in a closed position.

5. A plastic hatch assembly according to claim 4 in which the volume between the shoulder element and said gasket is greater than the volume between said U-shaped extension element and said gasket.

6. A plastic hatch assembly according to claim 5, which includes a drain to allow water accumulated in the volume between the gasket and the U-shaped extension element to flow out of the hatch assembly without entering the interior of the vessel.

7. A plastic hatch assembly according to claim 5, which includes an inner plastic frame member having an L-shaped cross section including an outwardly directed leg and means for fastening said two plastic frame members in superposed telescoping relationship so that said inner plastic frame member serves as an inner trim member on the inside of the vessel.

8. The hatch assembly according to claim 7, in which the volume between said outwardly extending shoulder element and said gasket is greater th an the volume between said U-shaped extension element and said gasket.

9. A hatch assembly having an open and closed position for fitting within an opening in a marine vessel, said hatch assembly comprising:

a shaped closing element having an outer peripheral area and a shaped frame member having an inwardly extending L-shaped cross section with an outwardly extending extension element at one end thereof surrounding said lens element in a superposed and overlapping arrangement with the peripheral area of said lens element adjacent to and essentially surrounded by said outwardly extending extension element when the hatch assembly is in a closed position, said frame member also including an outwardly extending shoulder element which forms a channel between said shoulder element and said outwardly extending extension element, means for fastening said frame member within the opening in the vessel and hinge means for rotatably fastening said lens element to said frame member for opening and closing the hatch assembly, gasket means disposed between the outer peripheral area of said lens element and said frame member and releasable clamp means for clamping said lens element and said frame member together in a closed position with said gasket means in sealing engagement with an outer peripheral area of said closing element and with said channel to thereby exclude water from an interior of a vessel.

10. A hatch assembly according to claim 9, which includes a second or inner frame member having an L-shaped cross section including an outwardly extending leg and means for fastening said two frame members in superposed telescoping relationship with one of said frame members forming an inner trim member on the inside of the vessel.

11. A hatch assembly according to claim 10, in which the L-shaped cross section of said frame member and of said inner frame member include a generally parallel adjacent segment with a rachet mechanism to thereby hold said frame members in a superposed relationship.

12. A hatch assembly according to claim 9, which includes a drain which allows any water accumulated in the volume between the gasket and the U-shaped extension element to flow out of the hatch assembly to thereby reduce the likelihood of any such water reaching the interior of the vessel.

* * * * *